US011542141B2

(12) United States Patent
Sun et al.

(10) Patent No.: US 11,542,141 B2
(45) Date of Patent: Jan. 3, 2023

(54) FUNNEL BASED ON BIVARIATE NORMAL DISTRIBUTION

(71) Applicant: Zhejiang University, Hangzhou (CN)

(72) Inventors: Yizhi Sun, Hangzhou (CN); Zhilin Sun, Hangzhou (CN); Haolei Zheng, Hangzhou (CN); Chunhong Hu, Hangzhou (CN)

(73) Assignee: Zhejiang University

( * ) Notice: Subject to any disclaimer, the term of this patent is extended or adjusted under 35 U.S.C. 154(b) by 0 days.

(21) Appl. No.: 17/556,265

(22) Filed: Dec. 20, 2021

(65) Prior Publication Data

US 2022/0194772 A1 Jun. 23, 2022

(30) Foreign Application Priority Data

Dec. 21, 2020 (CN) ..... 202011522436.9

(51) Int. Cl.
*B67C 11/02* (2006.01)

(52) U.S. Cl.
CPC ..... *B67C 11/02* (2013.01)

(58) Field of Classification Search
CPC ... B67C 11/00; B67C 11/02; B67C 2011/022; B67C 2011/025; B67C 2011/027
USPC ..... 141/331–345
See application file for complete search history.

(56) References Cited

U.S. PATENT DOCUMENTS 590,243 A * 9/1897 Smith ..... B67C 11/02 99/506
1,036,271 A * 8/1912 Lacy et al. ..... B67C 11/04 141/345
1,791,826 A * 2/1931 Middleton ..... A47J 43/288 7/113
D121,781 S * 8/1940 Wolcott ..... D7/700
4,638,841 A * 1/1987 Heath ..... F16N 31/002 141/286
D420,869 S * 2/2000 Diehl ..... D7/700
6,035,908 A * 3/2000 Hoffmann ..... B65B 39/00 141/331
6,318,422 B2 * 11/2001 Woratyla ..... B67C 11/02 141/342

(Continued)

FOREIGN PATENT DOCUMENTS

CN 2245600 Y 1/1997
CN 2845925 Y 12/2006

(Continued)

*Primary Examiner* — Timothy L Maust
(74) *Attorney, Agent, or Firm* — Dickinson Wright PLLC

(57) ABSTRACT

A funnel based on bivariate normal distribution is provided, and belongs to the field of daily tools. The funnel is formed by connecting a funnel body in a shape of a bivariate normal distribution with an outlet tube. The funnel body can be formed by rotating a normal distribution curve around the axis of symmetry z with a positive direction pointing to a deep part of the funnel, towards which the fluid flows. An outlet tube is a conical structure with a wide upper part and a narrow lower part. The surface of the funnel body has arbitrary order smoothness at everywhere. The design is simple and the fluid experiences little resistance when it flows through the inner surface. Thus, the funnel can effectively prevented blockage during the transport of fluid, powder and granules and the transport efficiency is remarkably improved.

2 Claims, 2 Drawing Sheets

(56) References Cited

U.S. PATENT DOCUMENTS

| | | | | |
|---|---|---|---|---|
| 6,880,589 | B2 * | 4/2005 | Camoli | F16N 31/004 141/331 |
| D562,091 | S * | 2/2008 | Ben Shlomo | D7/700 |
| D567,038 | S * | 4/2008 | Carallo | D7/700 |
| D635,398 | S * | 4/2011 | Watabe | D7/400 |
| D661,957 | S * | 6/2012 | Lee | D7/700 |
| D728,326 | S * | 5/2015 | Wirth | D7/700 |
| 9,242,843 | B2 * | 1/2016 | Nkwantabisa | B67C 11/02 |
| 10,111,989 | B2 * | 10/2018 | Foley | A61M 1/0001 |
| 10,595,537 | B2 * | 3/2020 | Girgenti | A21D 13/33 |
| D952,420 | S * | 5/2022 | Klipshtein | D7/700 |
| 2001/0032682 | A1 * | 10/2001 | Woratyla | B67C 11/02 141/333 |
| 2015/0136274 | A1 | 5/2015 | Nkwantabisa | |

FOREIGN PATENT DOCUMENTS

| | | | |
|---|---|---|---|
| CN | 202499426 | U | 10/2012 |
| CN | 104895007 | A | 9/2015 |
| CN | 109878915 | A | 6/2019 |

* cited by examiner

FUNNEL BASED ON BIVARIATE NORMAL DISTRIBUTION

CROSS REFERENCE TO RELATED APPLICATION BACKGROUND

This patent application claims the benefit and priority of Chinese Patent Application No. 202011522436.9 filed on Dec. 21, 2020, the disclosure of which is incorporated by reference herein in its entirety as part of the present application.

TECHNICAL FIELD

The present disclosure belongs to the technical field of daily tools, and specifically relates to a funnel based on bivariate normal distribution.

BACKGROUND ART

Funnel or funnel-shaped devices are widely applied to production and in daily life, and can be used for injecting liquid, powder, granules into a container with a small inlet or a pipe under gravity or certain forces. Common funnels are mainly composed of two parts, namely a conical funnel body and an outlet tube. The design of the funnel body usually only considers the volume and neglects the transport efficiency, so that the phenomena of blockage and overflowing frequently occur in the actual use of the funnel, causing inconvenience or other problems.

SUMMARY

The present disclosure aims to solve problems in the prior art, and provides a bivariate normal distribution funnel.

The present disclosure adopts the following technical solutions: a bivariate normal distribution funnel is formed by connecting a funnel body in the shape of a bivariate normal distribution with an outlet tube. More precisely, the funnel body is a bivariate surface in 3-dimensional space that can be expressed as below. The funnel can be formed by rotating a normal distribution curve around the axis of symmetry z with a positive direction pointing to a deep part of the funnel, towards which a fluid in the funnel flows:

$$z = \frac{k}{2\pi\sigma^2}\exp\left(-\frac{x^2+y^2}{2\sigma^2}\right)$$

where, x represents a first variable varying along a first direction in a horizontal plane, y represents a second variable varying along a second direction perpendicular to the first direction in the horizontal plane, the axis of symmetry z is perpendicular to the horizontal plane, sigma subscript x represents a standard deviation $\sigma_x$ of the first variable x, sigma subscript y represents a standard deviation $\sigma_y$ second variable y, and k represents a correction coefficient.

Furthermore, the outlet tube has a conical tubular structure with a wide upper part and a narrow lower part.

Compared with the prior art, the present disclosure has the following beneficial effects: the funnel body with the bivariate normal distribution has perfect smoothness at everywhere so that the fluid experiences little resistance when flowing through the funnel. The normal distribution shape can effectively prevent the funnel from being blocked during the transport of liquid, powder and granules are guided, and the transport efficiency is remarkably improved.

DETAILED DESCRIPTION OF THE EMBODIMENTS

The present disclosure is further described in detail below with reference to the attached figures.

Figure 1:
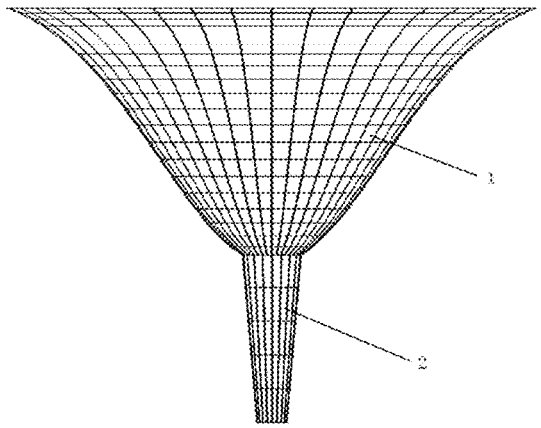
FIG. 1 is a front view of a bivariate normal distribution funnel.
Figure 2:
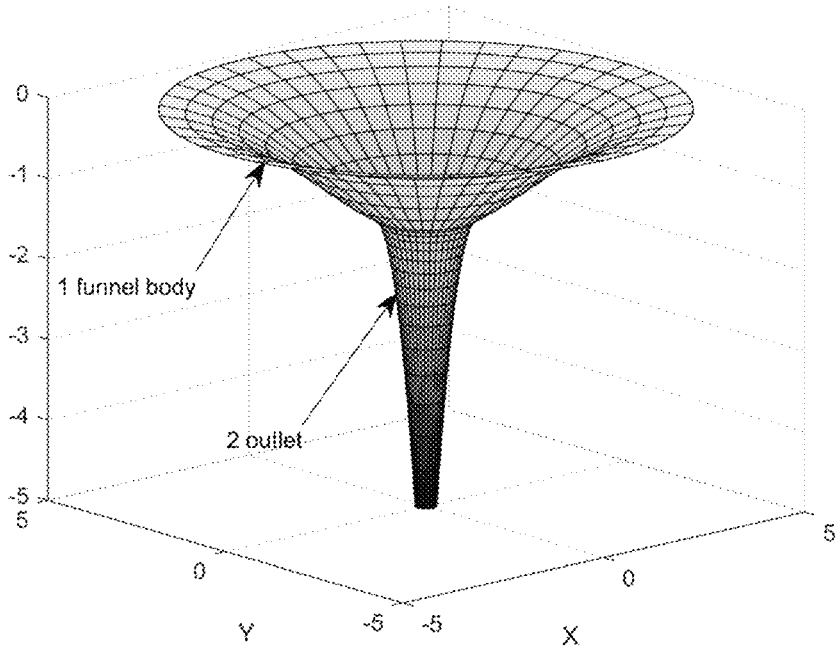
FIG. 2 is a perspective view of the bivariate normal distribution funnel.
Figure 3:
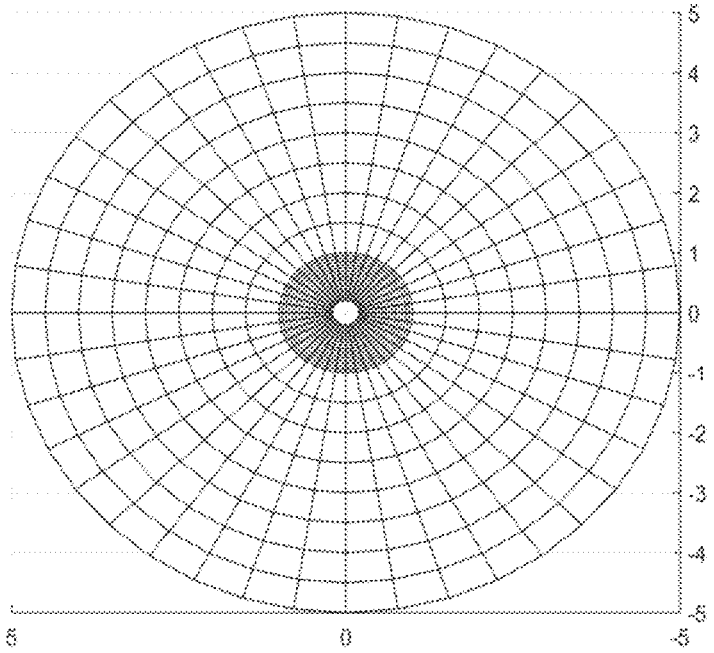
FIG. 3 is a top view of the funnel body.

FIG. 1 is a front view of a bivariate normal distribution funnel in the present disclosure, and FIG. 2 is a perspective view of a bivariate normal distribution funnel in the present disclosure. FIG. 3 shows a funnel body with a diameter of 10 cm at the entrance and a diameter of 2 cm at the connection with the outlet. The whole device is formed by smoothly connecting a funnel body 1 in the shape of a bivariate normal distribution with an outlet tube 2. Furthermore, the outlet tube 2 is a conical tubular structure with a wide upper part and a narrow lower part. The funnel body 1 can be formed by rotating a normal distribution curve around the axis of symmetry z with a positive direction pointing to a deep part of the funnel, towards which the fluid in the funnel flows, and expressed by the following equation:

$$z = f(x, y) = \frac{k}{2\pi\sigma^2}\exp\left(-\frac{x^2+y^2}{2\sigma^2}\right)$$

where x represents a first variable varying along a first direction in a horizontal plane, y represents a second variable varying along a second direction perpendicular to the first direction in the horizontal plan, and the axis of symmetry z is perpendicular to the horizontal plane, sigma subscript x represents a standard deviation $\sigma_x$ of the first variable x, sigma subscript y represents a standard deviation $\sigma_y$ of the second variable y, and k represents a correction coefficient.

Based on this, the funnel is smooth at everywhere, for the fluid flowing through the inlet of the funnel body 1. Therefore, the fluid experiences little resistance when flowing through the funnel due to the existence and continuity of arbitrary order derivatives of the surface function that describes the funnel body 1:

$$z = f(x, y) = \frac{k}{2\pi\sigma_x\sigma_y}\exp\left[\left(-\frac{x^2}{2\sigma_x^2}+\frac{y^2}{2\sigma_y^2}\right)\right]$$

According to the general equation, the first-order partial derivatives are:

$$\frac{\partial f}{\partial x} = \frac{-kx}{2\pi\sigma_x^3\sigma_y}\exp\left[-\left(\frac{x^2}{2\sigma_x^2}+\frac{y^2}{2\sigma_y^2}\right)\right]$$

and

-continued $$\frac{\partial f}{\partial y} = \frac{-ky}{2\pi\sigma_y^3\sigma_x}\exp\left[-\left(\frac{x^2}{2\sigma_x^2} + \frac{y^2}{2\sigma_y^2}\right)\right]$$

Now suppose that (m+n)th-order partial derivatives exist for nonnegative integers m and n, $$\frac{\partial^{m+n} f}{\partial x^m \partial y^n} = \sum_i P_i(x, y)\exp\left[-\left(\frac{x^2}{2\sigma_x^2} + \frac{y^2}{2\sigma_y^2}\right)\right]$$

in which $P_i$ are some polynomials, then (m+n+1)th-order partial derivatives can be written as:

$$\frac{\partial^{m+n+1} f}{\partial x^{m+1} \partial y^n} = \sum_i \tilde{P}_i(x, y)\exp\left[-\left(\frac{x^2}{2\sigma_x^2} + \frac{y^2}{2\sigma_y^2}\right)\right],$$

in which the function $\tilde{P}_i$ are polynomials as well with an expression:

$$\tilde{P}_i(x, y) = \frac{\partial}{\partial x}P_i(x, y) - \frac{x}{\sigma_x^2}P_i(x, y),$$

and thus are continuous and differentiable. Similarly, it can be proved that $$\frac{\partial^{m+n+1} f}{\partial x^m \partial y^{n+1}}$$

exists and is differentiable. Therefore arbitrary order smoothness of the funnel surface is proved recursively.

The funnel in the present disclosure can be applied to various types of discharge pipes in production and daily life, such as sewers, counter basins and oil pipeline, and is used for guiding various substances such as water bodies, oils and silt and mixtures thereof. When the funnel is used, the lower end of the outlet tube 2 is connected into an inlet of a corresponding container, and when the fluid, powder and granules are filled into the container, in view of the everywhere smoothness characteristic of the funnel surface, the device designed in this disclosure can effectively prevent blockage and improve transport efficiency.

What is claimed is:

1. A bivariate normal distribution funnel, wherein the funnel is formed by connecting a funnel body in a shape of a bivariate normal distribution with an outlet tube; the funnel body formed by rotating a normal distribution curve around an axis of symmetry z with a positive direction pointing to a deep part of the funnel, towards which a fluid in the funnel flows:

$$z = \frac{k}{2\pi\sigma^2}\exp\left(-\frac{x^2 + y^2}{2\sigma^2}\right)$$

wherein, x represents a first variable varying along a first direction in a horizontal plane, y represents a second variable varying along a second direction perpendicular to the first direction in the horizontal plane and the axis of symmetry z is perpendicular to the horizontal plane, sigma subscript x represents a standard deviation $\sigma_x$ of the first variable x, sigma subscript y represents a standard deviation $\sigma_y$ of the second variable y and k represents correction coefficient.

2. The bivariate normal distribution funnel according to claim 1, wherein the outlet tube is a conical tubular structure with a narrow lower part and a wide upper part.

* * * * *